United States Patent [19]

Boberg et al.

[11] Patent Number: 4,852,493

[45] Date of Patent: Aug. 1, 1989

[54] FERRITE CORE COUPLED SLAPPER DETONATOR APPARATUS AND METHOD

[75] Inventors: Ralph E. Boberg; Ronald S. Lee; Richard C. Weingart, all of Livermore, Calif.

[73] Assignee: The United States of America as represented by the United States Department of Energy, Washington, D.C.

[21] Appl. No.: 155,439

[22] Filed: Feb. 12, 1988

[51] Int. Cl.[4] ..... F42B 3/12; F42C 19/12

[52] U.S. Cl. ..... 102/202.5; 102/202.7; 102/204

[58] Field of Search ..... 102/200, 202.5, 202.7, 102/204, 206, 202.14

[56] References Cited

U.S. PATENT DOCUMENTS

| | | | |
|---|---|---|---|
| 3,978,791 | 9/1976 | Lemley et al. | 102/202.14 |
| 4,144,814 | 3/1979 | Day et al. | 102/202.14 |
| 4,297,947 | 11/1981 | Jones et al. | 102/206 |
| 4,312,271 | 1/1982 | Day et al. | 102/202.14 |
| 4,471,697 | 9/1984 | McCormick et al. | 102/202.5 |
| 4,601,243 | 7/1986 | Ueda et al. | 102/206 |
| 4,602,565 | 7/1986 | MacDonald et al. | 102/202.14 |

OTHER PUBLICATIONS

Stroud, John R.; "*A New Kind of Detonator—The Slapper*", UCRL-77639; Feb. 1976.

*Primary Examiner*—Charles T. Jordan
*Attorney, Agent, or Firm*—Gary C. Roth; L. E. Carnahan; William R. Moser

[57] ABSTRACT

Method and apparatus are provided for coupling a temporally short electric power pulse from a thick flat-conductor power cable into a thin flat-conductor slapper detonator circuit. A first planar and generally circular loop is formed from an end portion of the power cable. A second planar and generally circular loop, of similar diameter, is formed from all or part of the slapper detonator circuit. The two loops are placed together, within a ferrite housing that provides a ferrite path that magnetically couples the two loops. Slapper detonator parts may be incorporated within the ferrite housing. The ferrite housing may be made vacuum and water-tight, with the addition of a hermetic ceramic seal, and provided with an enclosure for protecting the power cable and parts related thereto.

8 Claims, 8 Drawing Sheets

FERRITE CORE COUPLED SLAPPER DETONATOR APPARATUS AND METHOD

The United States Government has rights in this invention pursuant to Contract No. W-7405-ENG-48 between the U.S. Department of Energy and the University of California for the operation of the Lawrence Livermore National Laboratory.

BACKGROUND OF THE INVENTION

The invention described herein relates generally to slapper detonators, and more particularly to method and apparatus for supplying electric power to slapper detonators.

The well-known slapper detonator, described by John R. Stroud in the Lawrence Livermore Laboratory document UCRL-77639 dated Feb. 27, 1976 and titled "A New Kind of Detonator—The Slapper", operates by exploding a thin metal foil that drives a film of dielectric material across a gap to impact on a high-density explosive. The thin conductive metal foil is explosively vaporized with an electric current pulse that must have exactly the right characteristics for the detonator to function. In many applications, the foil comprises part of a thin portion of a flat-conductor detonator circuit. This thin portion must be short enough so that its resistance is no more than a few milliohms, and its inductance adds no more than a few nanohenrys to the inductance of the whole detonator circuit.

Concurrently, the thin conductive foil must be the most resistive component of the thin portion of the flat-conductor detonator circuit. Although the optimal parameters of the electric current pulse required to fire any slapper detonator will depend upon the specific geometry and material composition of that detonator and its thin conductive foil, the electric pulse typically must have a peak amplitude of about 2 to 4 kiloamps and a duration of approximately a few tenths of a microsecond. The electric pulse must deliver its energy to the thin foil in a time that is appreciably less than the time that it would take for the vaporized foil to come to thermal equilibrium with its surroundings.

It would be advantageous if electric power could be discriminatively distributed to multiplicities of slapper detonators dispersed throughout explosive assemblies such as mass-produced munitions. This process of distribution would be of increased benefit if it could be carried out under a varied spectrum of adverse environmental conditions, such as at reduced or elevated temperatures, or at pressures ranging from vacuum to superatmospheric. It would clearly be convenient to transport electric power to each slapper detonator of a detonator multiplicity via its own individual thick flat-conductor power cable, with the requisite multiplicity of power cables all coming from a single pulse generator. These coordinated groupings of power cables could advantageously be individually tailored for electric power pulse timing. Power cables suitable for this usage would have low inductance and resistance, typically only a few tens of both nanohenrys and milliohms. This potentially beneficial process of power distribution would require the transfer of temporally short electric power pulses from thick flat-conductor power cables into thin flat-conductor slapper detonator circuits. There are two known means for doing this.

One of these known means requires the power cables to be attached to the detonator circuits with electrical connectors. Unfortunately, the presently existing electrical connectors that can be used for this purpose are expensive and very complicated because of the wide array of different environments within which they must potentially function. These connectors tend to be bulky and heavy, have multiple seals, require soldering, and are very labor-intensive to work with. This last factor is especially disadvantageous if the connectors must be subject to integrity verification over extended and appreciable periods of time. Thus, while this methodology is potentially available for use, it is clearly beset with many detrimental conditions and inconveniences.

The other known solution to the short electric power pulse transfer problem involves permanently attaching the power cables to the detonator circuits in integrated assemblies. The two conductors that form the end of each flat-conductor power cable would be flared apart and soldered to the ends of the related thin flat-conductor detonator circuit loop that includes the thin conductive foil that is to be explosively vaporized in use, with the attached portion of the assembly permanently sealed between plastic layers. This possible solution is labor intensive, fairly expensive, and since it does not permit the detonator circuit to be detached from the firing circuit during times of system maintenance, potentially quite hazardous. Thus, this second methodology is also not a satisfactory solution to the problem presently under consideration.

The efficiency of air core transformers is not sufficiently high to provide a solution to the instant problem. Additionally, before the advent of the present invention it was commonly believed by those skilled in the relevant arts that the frequency response of ferrite core transformers was too slow for the power pulse transfer of temporally short electric pulses from thick flat-conductor power cables to thin flat-conductor detonator circuits, because such transformers are commonly known to be rated at frequencies no higher than about 400 KHz, while the approximately a few tenths of a microsecond electric power pulse required to vaporize a slapper detonator thin foil has a fundamental frequency of several MHz.

SUMMARY OF THE INVENTION

It is, therefore, an object of this invention to provide method and apparatus for the transfer of a temporally short electric power pulse from a thick flat-conductor power cable into a thin flat-conductor circuit.

Another object of this invention is to provide the above method and apparatus in situations where the temporally short electric power pulse has a peak amplitude in the range extending from zero to about 10 kiloamps and a duration of approximately a few tenths of a microsecond, and the thin flat-conductor circuit is a thin flat-conductor slapper detonator circuit.

Yet another object of this invention is that the above method and apparatus be inexpensive and simple, involve parts that are light in weight and not large, and not be labor-intensive to work with.

A further object of this invention is that the above method and apparatus permit the slapper detonator circuit to be easily detached and reattached to the power cable.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purpose of the present invention, as embodied and broadly described herein, slapper detonator-related method and apparatus are provided for coupling a temporally short electric power pulse that has a duration of from about 0.1 to 0.4 microseconds and a peak amplitude in the range extending from zero to about 10 kiloamps, from a thick flat-conductor power cable that has input and output conductors, into the thin flat-conductor slapper detonator circuit that includes the thin conductive metal foil that, in use, is to be explosively vaporized by the electric power pulse. The input and output end portions of the power cable are circularly and planarly flared apart and conductively joined at their termini to form a first planar and generally circular loop. All or part of the thin flat-conductor slapper detonator circuit is fabricated and formed into a second planar and generally circular loop that has a diameter that is approximately equal to that of the first circular loop that is formed with the power cable. The two planar and generally circular loops are placed in close proximity with one another along their respective circumferences, and confined within a ferrite housing that provides a ferrite path that magnetically couples the two loops.

In the situation where the second planar and generally circular loop is formed from all of the thin flat-conductor slapper detonator circuit, so that the thin conductive metal foil is located within the ferrite housing, it is often preferable to incorporate a slapper detonator barrel within the ferrite housing and in association with the thin conductive metal foil. It is then preferable to also introduce a slapper detonator high-explosive pellet within the ferrite housing, with the pellet in association with the slapper detonator barrel.

In situations where the thin conductive metal foil is located externally to the ferrite housing, it is frequently preferable that the ferrite housing be comprised of a ferrite circular annular ring that is coaxially and encirclingly disposed about a solid central ferrite right circular cylinder, and two ferrite end cap disks symmetrically disposed perpendicularly to the axis of, and on either side of, the ferrite ring and cylinder. It is then preferable that a hermetic ceramic seal be emplaced between the ferrite ring and the ferrite cylinder.

In the situations described in the immediately preceeding paragraph, it is often preferred to provide an enclosure for the thick flat-conductor power cable, and apparatus related thereto, with the enclosure touchingly and circumferentially contiguous to the ferrite circular annular ring.

The benefits and advantages of the present invention, as embodied and broadly described herein, include, inter alia, the provision of method and apparatus for the transfer of a temporally short electric power pulse, and particularly an electric power pulse having a duration of from about 0.1 to 0.4 microseconds and a peak amplitude in the range extending from zero to about 10 kiloamps, from a thick flat-conductor power cable into a thin flat conductor circuit, particularly a thin flat-conductor slapper detonator circuit. Further benefits and advantages derive from the circumstance that the present invention may be implemented with simple and inexpensive, small and lightweight parts that are not labor intensive to work with and that permit the power cable to be easily attached to and detached from the slapper detonator circuit.

BRIEF DESCRIPTION OF THE DRAWINGS

The accompanying drawings, which are incorporated in and form a part of the specification, illustrate an embodiment of the invention and, together with the description, serve to explain the principles of the invention. In the drawings.

DETAILED DESCRIPTION OF THE INVENTION

Figure 1:
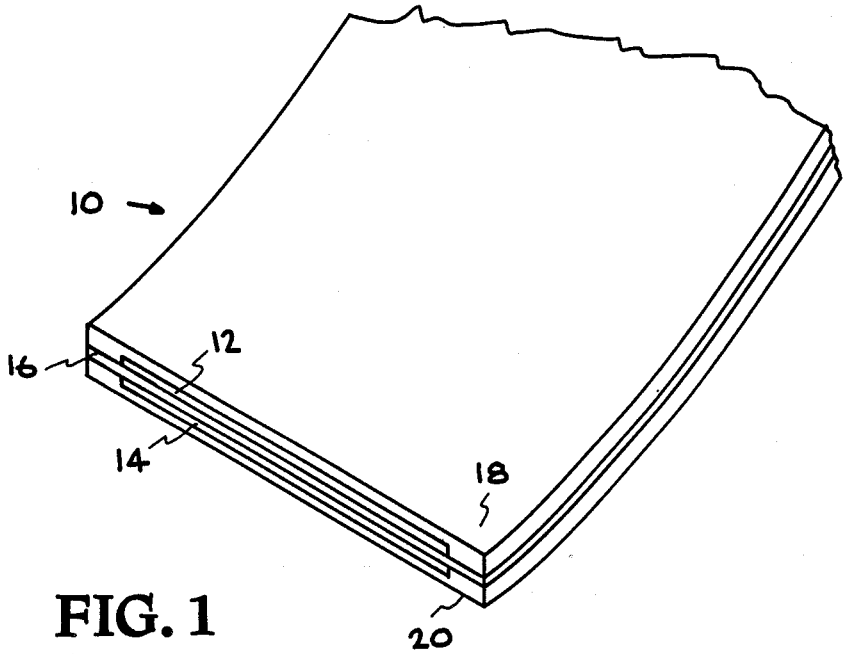
FIG. 1 (PRIOR ART)
FIG. 1 (Prior Art) is a perspective end view of a typical thick flat-conductor power cable, as used in the practice of this invention.

Reference will now be made in detail to the present preferred embodiment of the invention, an example of which is shown in the accompanying drawings. Reference is first made to FIG. 1 which shows a perspective end view of a thick flat-conductor power cable 10 that is typical of such power cables as known and used in the prior art. Power cable 10 comprises an input conductor 12, an output conductor 14, an insulator 16 that separates conductors 12 and 14, and encapsulating or covering layers 18 and 20. Conductors 12 and 14 are typically comprised of copper, but may be comprised of any solid conducting material. Insulator 16 and covering layers 18 and 20 are typically comprised of various plastic materials, frequently transparent, as well known in the electronic and related arts.

The entire thickness of typical flat-conductor power cables, such as cable 10, is usually only slightly greater than that of a sheet of paper, so that the individual layered parts of the cable ordinarily cannot easily be visually distinguished from one another. These cables are usually quite flexible.

Figure 2:
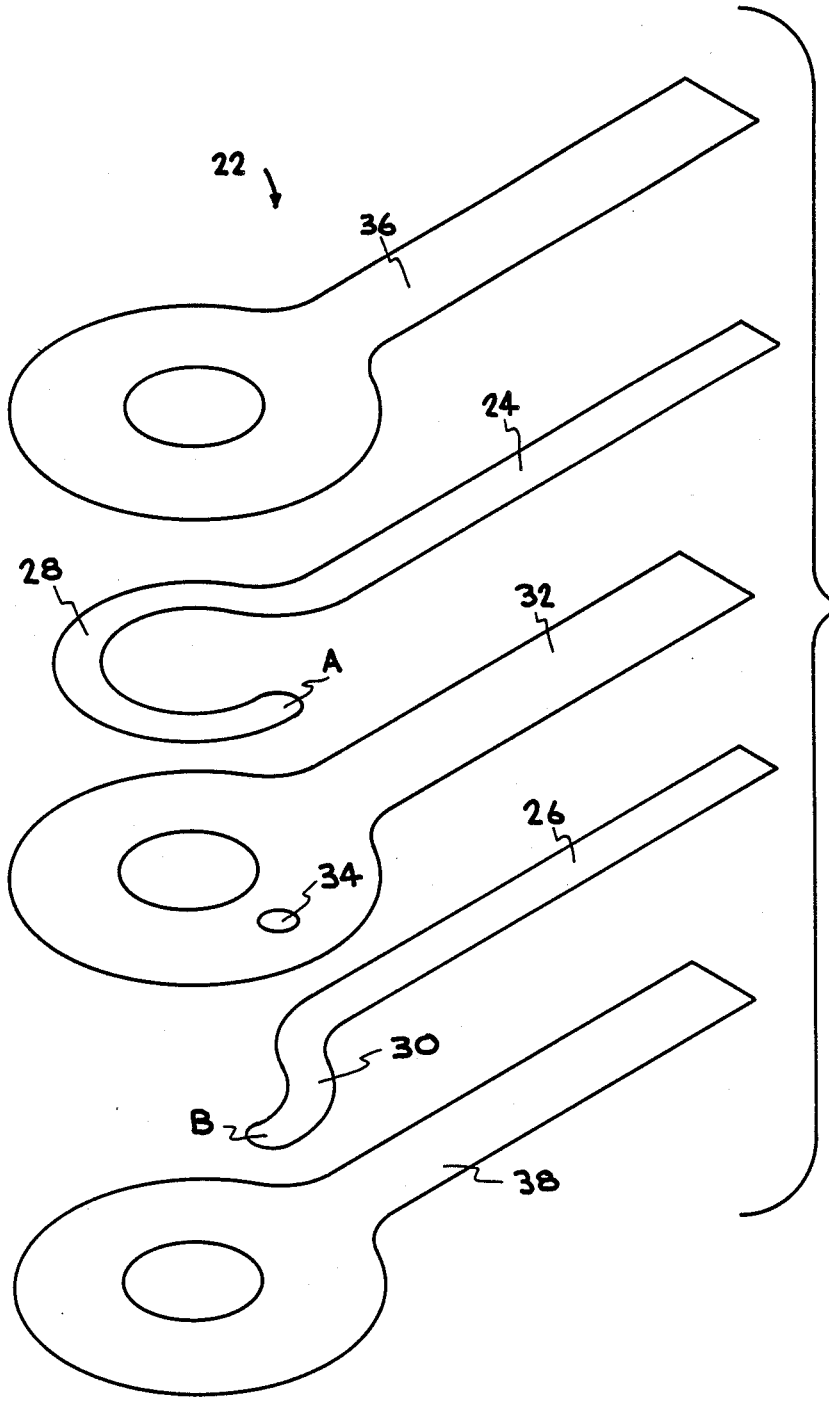
FIG. 2 is an exploded view of a thick flat-conductor power cable terminated in a planar and generally circular loop, made in accordance with the invention.

Reference is now made to FIG. 2, which shows an exploded view of the components of a thick flat-conductor power cable 22, that is terminated in a planar and generally circular loop, as required in the practice of this invention. Power cable 22 is comprised of input conductor 24 and output conductor 26. An input end portion 28 of input conductor 24, and an adjoining output end portion 30 of output conductor 26, are each circularly and planarly flared apart, as shown. The flaring, and related, procedures may be conveniently carried out in the manufacturing process of power cable 22. An insulator 32, that terminates in a planar and generally circular loop, as shown, and having a hole 34, separates and insulates conductor 24 from conductor 26. In manufacture, the termini, A and B, of conductors 24 and 26, respectively, that touch through hole 34, are conductively joined by welding or soldering or any other suitable process. Power cable 22 is protected by a pair of encapsulating or covering layers 36 and 38, each of which terminate in a planar and generally circular loop, as shown. When assembled, by means that are well understood in the art, power cable 22 is very flexible, and may be easily and conveniently manipulated in the practice of this invention.

Figure 3:
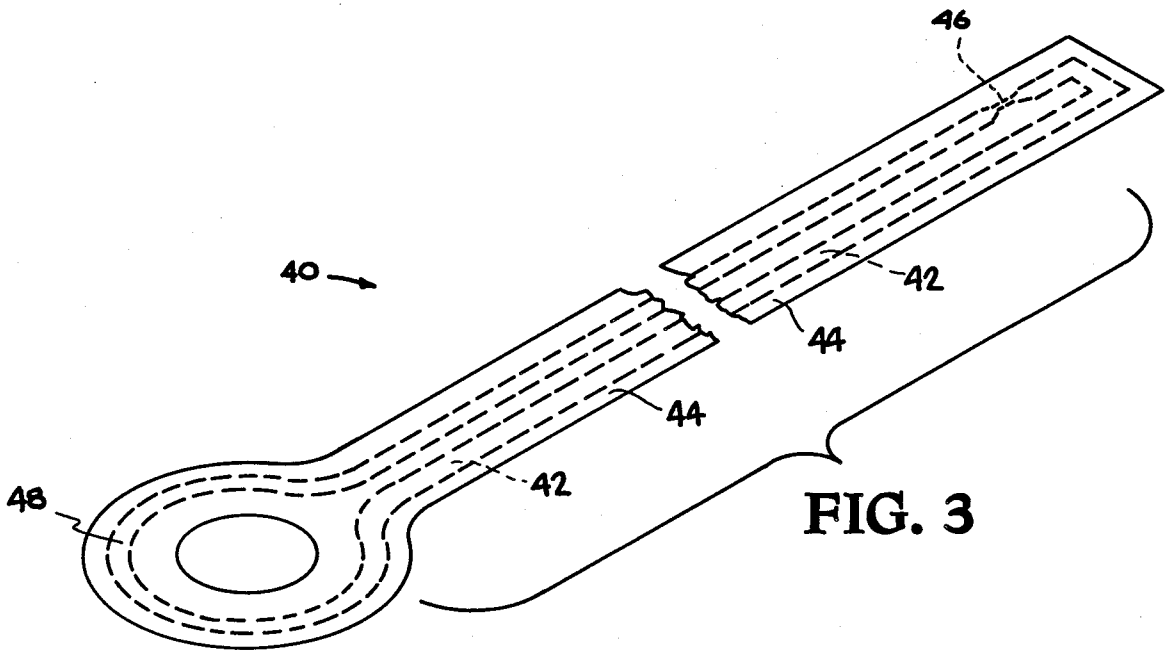
FIG. 3 is a perspective and schematic view of a thin flat-conductor slapper detonator circuit terminated in a planar and generally circular loop, made in accordance with the invention.

FIG. 3 is a perspective and schematic view of a thin flat-conductor slapper detonator circuit 40. Circuit 40 is shown as comprised of a thin, flat-conductor 42, that is protected by an encapsulating cover 44, and a thin conductive metal foil 46 that is, in use, adapted to be explosively vaporized by an electric power pulse. Conductor 42 may be comprised of copper or any other conductive solid material. The thin flat-conductor slapper detonator circuit 40 is shown as partly fabricated into a planar and generally circular loop 48.

Figure 4:
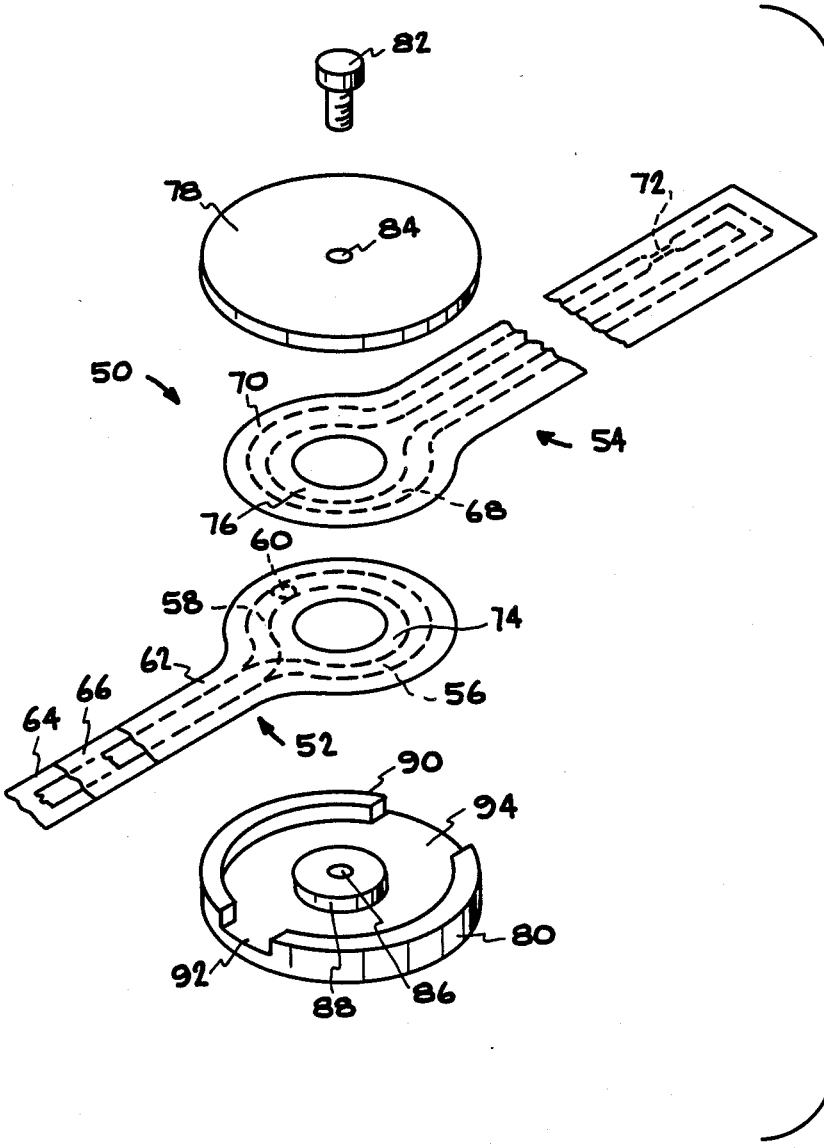
FIG. 4 is an exploded view of an apparatus for coupling a temporally short electric power pulse from a thick flat-conductor power cable into a thin flat-conductor slapper detonator circuit, made in accordance with the invention.

Reference is now made to FIG. 4, which shows an exploded view of an apparatus 50 for coupling a temporally short electric power pulse, that has a duration of from about 0.1 to 0.4 microseconds and a peak amplitude in the range extending from zero to about 10 kiloamps, from a thick flat-conductor power cable 52, into a thin flat-conductor slapper detonator circuit 54, in accordance with the invention. Electric power pulses, as described, may be generated by many means, not shown, that are very well known in the electronic, and related, arts. The thick flat-conductor power cable 52 is similar to cable 22, shown in FIG. 2, and comprises an input conductor 56 and an output conductor 58 that are conductively joined at a location 60. Power cable 52 is protected by a pair of encapsulating or covering layers 62 and 64, and conductors 56 and 58 are separated by an insulator 66. The thin flat-conductor slapper detonator circuit 54 is similar to circuit 40, shown in FIG. 3. Slapper detonator circuit 54 comprises a thin, flat conductor 68, an encapsulating cover 70, and a thin conductive metal foil 72. As shown, power cable 52 comprises a first planar and generally circular loop 74, and slapper detonator circuit 54 comprises a second planar and generally circular loop 76, with loops 74 and 76 each having approximately the same diameter and adapted for placement in close proximity with one another along their respective circumferences. Loops 74 and 76 are intended for confinement within a ferrite housing that comprises a ferrite cap 78, a ferrite base 80, and a ferrite or plastic screw 82, with the screw 82 intended to, in use, secure cap 78 and base 80 together For this purpose cap 78 is provided with a screw hole 84, and base 80 is provided with a screw hole 86. The ferrite base 80 is shown with a raised central portion 88, for extension between loops 74 and 76, a raised outer rim 90, and slots 92 and 94 in rim 86, for accommodation of power cable 52 and slapper detonator circuit 54, respectively. The ferrite housing comprised of ferrite cap 78 and ferrite base 80 provides a ferrite path that magnetically couples the first planar and generally circular loop 74 of power cable 52 to the second planar and generally circular loop 76 of the slapper detonator circuit 54. The apparatus 50 shown in FIG. 4 will couple a temporally short electric power pulse having a duration of from about 0.1 to 0.4 microseconds and a peak amplitude in the range extending from zero to about 10 kiloamps from power cable 52 into slapper detonator circuit 54. It is emphasized, however, that the particular configuration of the ferrite housing, shown as comprised of cap 78 and base 82, is not critical to the method and apparatus of this invention, and many other ferrite housing configurations, so long as they provide a ferrite path that magnetically couples power cable loop 74 to slapper detonator circuit loop 76, are possible in the efficacious practice of this invention.

Figure 5:
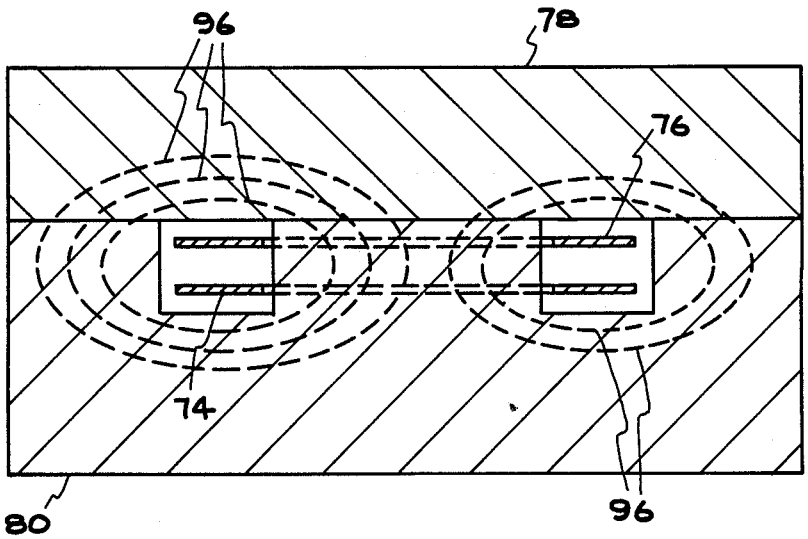
FIG. 5 is a cross-sectional side view of the apparatus shown in FIG. 4.

Reference is now made to FIG. 5, which shows an assembled, cross-sectional side view of the apparatus of FIG. 4. The view is not taken through the slotted portion of ferrite base 80, and, for clarity, screw 82 and screw holes 84 and 86 are not shown. FIG. 5 shows ferrite cap 78, ferrite base 80, the external surface of first planar and generally circular power cable loop 74, and the external surface of second planar and generally circular detonator circuit loop 76 with the two loops shown spaced apart for reasons of clarity. The purpose of FIG. 5 is to show a plurality of typical ferrite paths 96, indicated by dashed lines, that magnetically couple loops 74 and 76.

Figure 6:
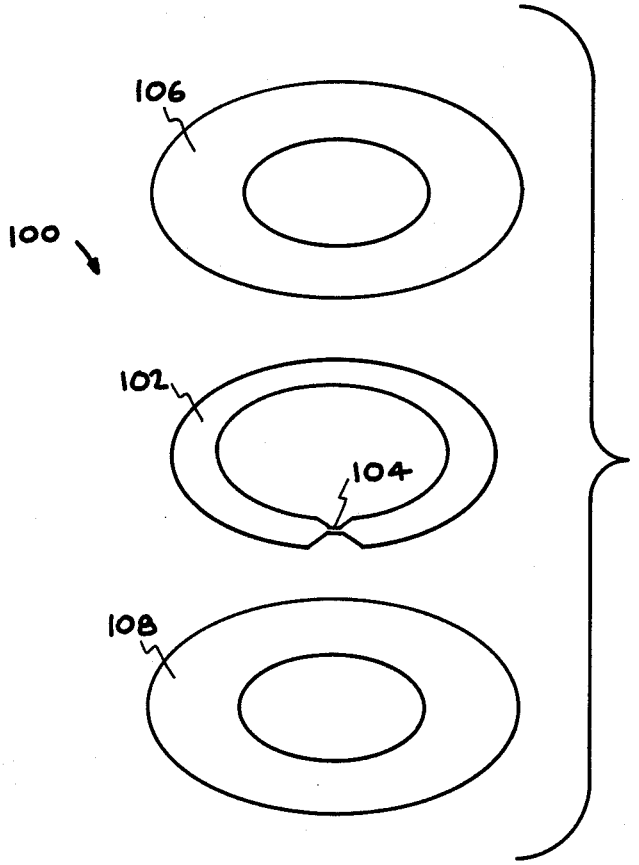
FIG. 6 is an exploded view of an entire thin flat-conductor slapper detonator circuit fabricated into a planar and generally circular loop, made in accordance with the invention.

Reference is now made to FIG. 6, which is an exploded view of a thin flat-conductor slapper detonator circuit 100, in accordance with the invention. Circuit 100 is comprised of a thin flat conductor 102, that is entirely fabricated into a planar and generally circular loop, and a conductive metal foil 104, that is adapted to be explosively vaporized, in use, by an electric power pulse. Conductor 102 may be comprised of copper or any other conductive solid material. Circuit 100 further comprises a top protective covering layer 106 and a bottom protective covering layer 108, with layers 106 and 108 configured as planar and generally circular loops, as shown. Thus, the thin flat-conductor slapper detonator circuit 100 is entirely all fabricated into a planar and generally circular loop.

Figure 7:
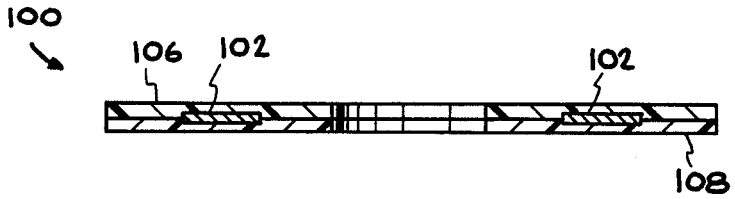
FIG. 7 is a cross-sectional side view of the planar and generally circular loop of FIG. 6.

FIG. 7 is a cross-sectional side view of the detonator circuit 100, of FIG. 6, not taken through conductive metal foil 104. FIG. 7 shows the thin flat conductor 102, and protective covering layers 106 and 108.

Figure 8:
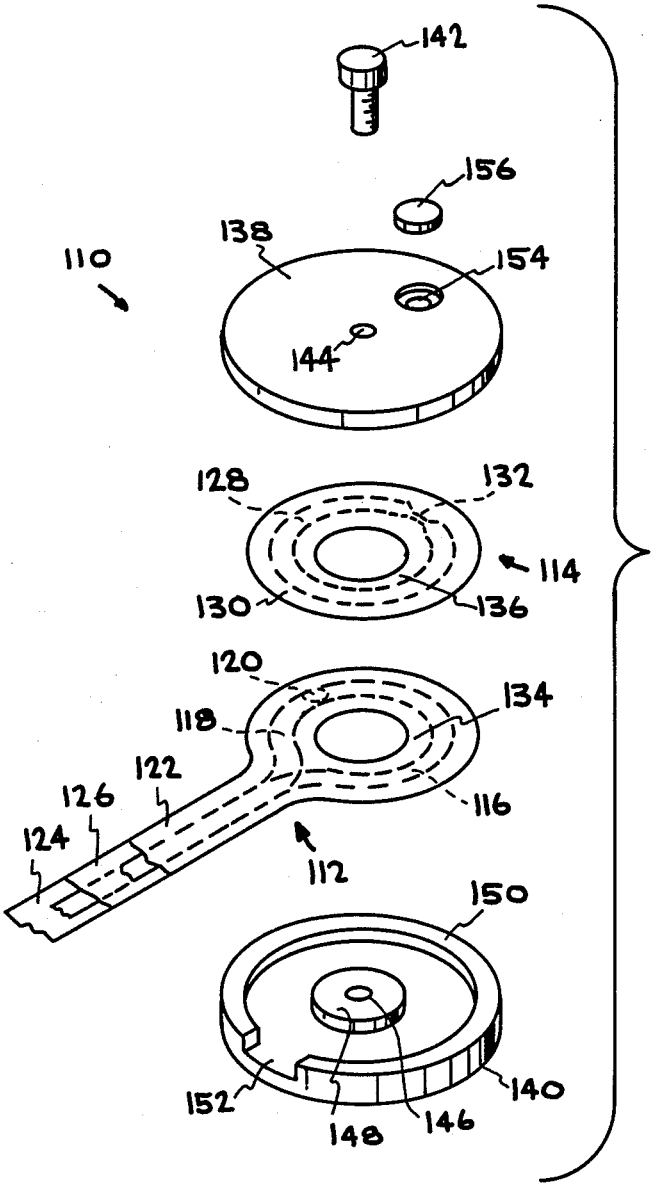
FIG. 8 is an exploded view of an alternative embodiment of apparatus for coupling a temporally short electric power pulse from a thick flat-conductor power cable into a thin flat-conductor slapper detonator circuit, made in accordance with the invention.

Reference is now made to FIG. 8, which shows an exploded view of a preferred apparatus 110 for coupling a temporally short electric power pulse, that has a duration of from about 0.1 to 0.4 microseconds and a peak amplitude in the range extending from zero to about 10 kiloamps, from a thick flat-conductor power cable 112, into a thin flat-conductor slapper detonator circuit 114, that is entirely all fabricated into a planar and generally circular loop, in accordance with the invention. The thick flat-conductor power cable 112 is similar to cable 22, shown in FIG. 2, and comprises an input conductor 116 and an output conductor 118 that are conductively joined at a location 120. Power cable 112 is protected by a pair of encapsulating or covering layers 122 and 124, and conductors 116 and 118 are separated by an insulator 126. The thin flat-conductor slapper detonator circuit 114 is similar to circuit 100, shown in FIGS. 6 and 7. Slapper detonator circuit 114 comprises a thin, flat conductor 128, an encapsulating cover 130, and a thin conductive metal foil 132. As shown, power cable 112 comprises a first planar and generally circular loop 134, and slapper detonator circuit 114 comprises a second planar and generally circular loop 136, with loops 134 and 136 each having approximately the same diameter and adapted for placement in close proximity with one another along their respective circumferences. Loops 134 and 136 are intended for confinement within a ferrite housing that comprises a ferrite cap 138, a ferrite base 140, and a ferrite or plastic screw 142, with the screw 142 intended to, in use, secure cap 138 and base 140 together. For this purpose cap 138 is provided with a screw hole 144, and base 140 is provided with a screw hole 146. The ferrite base 140 is shown with a raised central portion 148, for extension between loops 134 and 136, a raised outer rim 150, and a slot 152 in rim 150, for accommodation of power cable 112. The ferrite housing comprised of ferrite cap 138 and ferrite base 140 provides a ferrite path that magnetically couples the first planar and generally circular loop 134 of power cable 112 to the second planar and generally circular loop 136 of the slapper detonator circuit 114. The thin conductive metal foil 132 is located within the ferrite housing comprised of ferrite cap 138 and ferrite base 140, as shown. A slapper detonator barrel 154 is incorporated within ferrite cap 138, of the ferrite housing, in association or alignment with the thin conductive metal foil 132, as shown. A slapper detonator high-explosive pellet 156 is incorporated within ferrite can 138 of the ferrite housing, in association or alignment with the slapper detonator barrel 154, as shown. In this manner the components comprising a slapper detonator may be incorporated within the ferrite housing itself. The apparatus 110 shown in FIG. 8 will couple a temporally short electric power pulse having a duration of from about 0.1 to 0.4 microseconds and a peak amplitude in the range extending from zero to about 10 kiloamps from power cable 112 into slapper detonator circuit 114.

Figure 9:
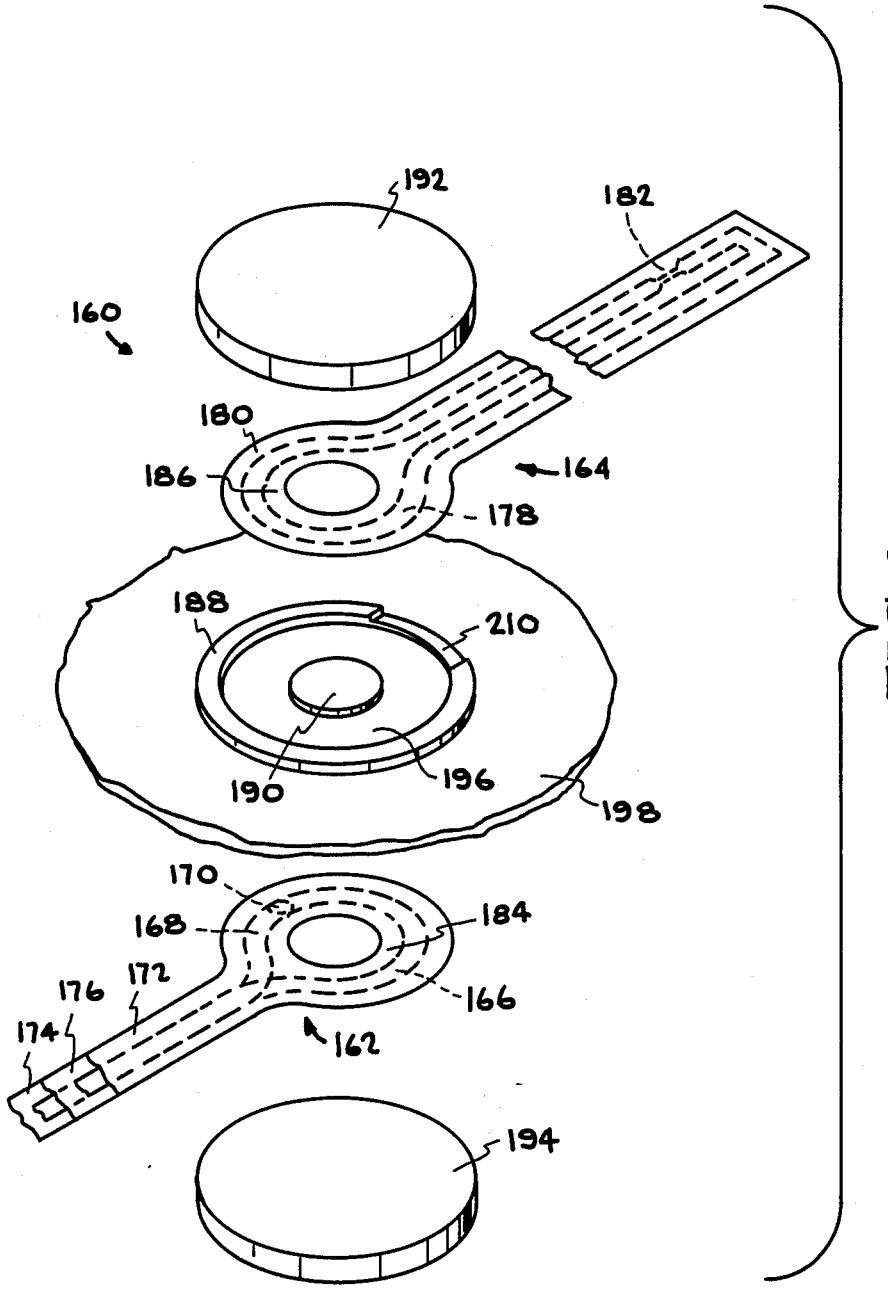
FIG. 9 is an exploded view of a second alternative embodiment of apparatus for coupling a temporally short electric power pulse from a thick flat-conductor power cable into a thin flat-conductor slapper detonator circuit, made in accordance with the invention.
Figure 10:
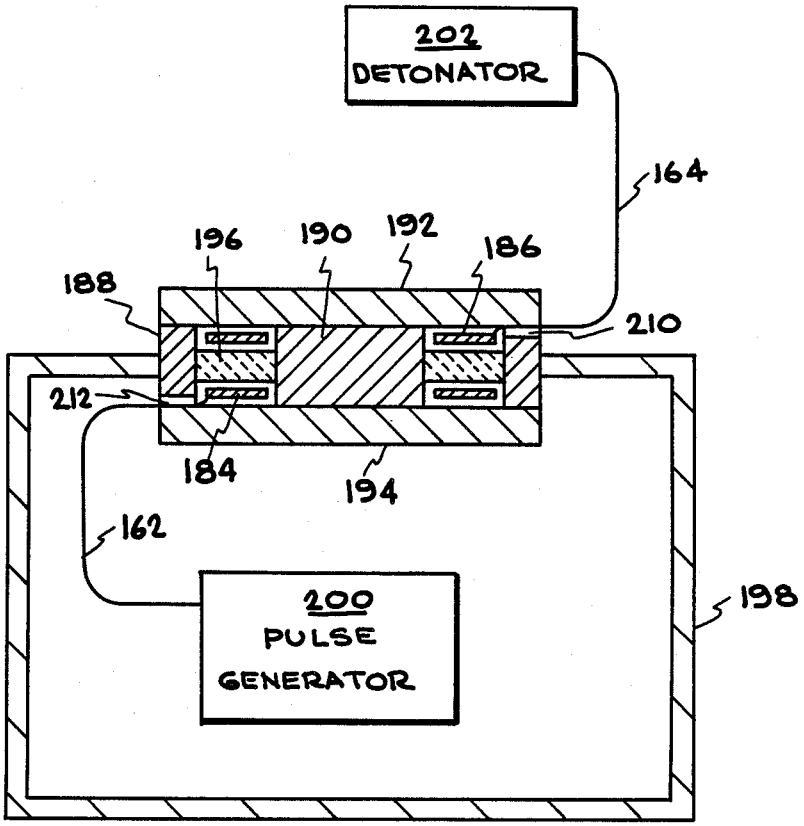
FIG. 10 is a schematic, cross-sectional side view of the apparatus of FIG. 9 and additional related apparatus.

Reference is now made to FIG. 9, which shows an exploded view of a preferred apparatus 160 for coupling a temporally short electric power pulse, that has a duration of from about 0.1 to 0.4 microseconds and a peak amplitude in the range extending from zero to about 10 kiloamps, from a thick flat-conductor power cable 162, into a thin flat-conductor slapper detonator circuit 164, that is partially fabricated into a planar and generally circular loop, in accordance with the invention. The thick flat-conductor power cable 162 is similar to cable 22, shown in FIG. 2, and comprises an input conductor 166 and an output conductor 168 that are conductively joined at a location 170. Power cable 162 is protected by a pair of encapsulating or covering layers 172 and 174, and conductors 166 and 168 are separated by an insulator 176. The thin flat-conductor slapper detonator circuit 164 is similar to circuit 40, shown in FIG. 3. Slapper detonator circuit 164 comprises a thin, flat conductor 178, an encapsulating cover 180, and a thin conductive metal foil 182. As shown, power cable 162 comprises a first planar and generally circular loop 184, and slapper detonator circuit 164 comprises a second planar and generally circular loop 186, with loops 184 and 186 each having approximately the same diameter and adapted for placement in close proximity with one another along their respective circumferences. Loops 184 and 186 are intended for confinement within a ferrite housing that comprises a ferrite circular annular ring 188, with ring 188 coaxially and encirclingly disposed about a solid central ferrite right circular cylinder 190, and two ferrite end cap disks, 192 and 194, that are symmetrically disposed perpendicularly to the axis of, and on either side of, ring 188 and cylinder 190. A hermetic ceramic seal 196 is emplaced between ferrite ring 188 and ferrite cylinder 190. To accommodate loops 184 and 186, ferrite circular annular ring 188 is provided with slots 210 and 212. Slot 212 is similar to slot 210 and is shown in FIG. 10. The ferrite housing comprised of ferrite ring 188, ferrite cylinder 190, and ferrite end cap disks 192 and 194, provides a ferrite path that magnetically couples the first planar and generally circular loop 184 of power cable 162 to the second planar and generally circular loop 186 of the slapper detonator circuit 164. End cap disks 192 and 194 may be attached to ferrite ring 188 and ferrite cylinder 190 by any appropriate means, such as gluing, welding or screws, not shown. Apparatus 160 further comprises an enclosure 198, only a part of which is shown in FIG. 9, that is touchingly and circumferentially contiguous to ferrite annular ring 188. Apparatus 160 has the great advantage of being vacuum and water-tight, because of hermetic ceramic seal 196. The apparatus 160 shown in FIG. 9 will couple a temporally short electric power pulse having a duration of from about 0.1 to 0.4 microseconds and a peak amplitude in the range extending from zero to about 10 kiloamps from power cable 162 into slapper detonator circuit 164.

Reference is now made to FIG. 10, which is a schematic, cross-sectional side view of the apparatus, assembled, of FIG. 9 together with additional related apparatus. The ferrite housing comprising ferrite circular annular ring 188, ferrite central cylinder 190, and ferrite end cap disks 192 and 194, is shown. Slots 210 and 212, in ferrite ring 188, are shown. The hermetic ceramic seal 196, that makes the ferrite housing assembly vacuum and water-tight, is shown. Power cable 162, coming from an electric pulse generator 200, schematically represented, is shown leading to the first planar and generally circular loop 184. The slapper detonator circuit 164 is shown extending from the second planar and generally circular loop 186, to a slapper detonator 202, schematically represented. The enclosure 198 is shown to completely surround and protect the thick flat conductor power cable 162. Enclosure 198 may be attached to the annular ferrite ring 188 by any appropriate means, such as gluing, welding, soldering, or the addition of additional parts specifically for that purpose, not shown. Detonator circuit 164 and slapper detonator 202 are external to the enclosure 198.

It is thus appreciated that in accordance with the invention as herein described and shown in FIGS. 2 to 10, method and apparatus for the transfer of temporally short electric power pulses, particularly those pulses having a duration of from about 0.1 to 0.4 microseconds and a peak amplitude in the range extending from zero to about 10 kiloamps, from thick flat-conductor power cables and into thin flat-conductor slapper detonator circuits, is provided. The invention may be implemented with simple and inexpensive, small and lightweight parts that are not labor intensive to work with and that permit the power cables to be easily attached to and detached from the slapper detonator circuits.

The foregoing description of a preferred embodiment of the invention has been presented for purposes of illustration and description. It is not intended to be exhaustive or to limit the invention to the precise form disclosed, and obviously many modifications and variations are possible in light of the above teaching. For example, a slapper detonator circuit planar and generally circular loop may be hermetically separated from a related power cable planar and generally circular loop by a thin, non-ferrite membrane centrally included between the two loops and within the ferrite housing that provides a ferrite path for magnetically coupling the two loops. Such membranes, if less than about 0.25 millimeters in thickness, will degrade coupling efficiency by only a few percent.

The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

We claim:

1. A slapper detonator-related apparatus, for coupling a temporally short electric power pulse, that has a duration of from about 0.1 to 0.4 microseconds and a peak amplitude in the range extending from zero to about 10 kiloamps, from a thick flat-conductor power cable, that comprises an input conductor and an output conductor, into a thin flat-conductor slapper detonator circuit, that comprises a thin conductive metal foil that is, in use, adapted to be explosively vaporized by the electric power pulse, the apparatus comprising:

a first planar and generally circular loop, formed from an end portion of the input conductor and an adjoining end portion of the output conductor, with the two portions circularly and planarly flared apart and conductively joined at their termini;

a second planar and generally circular loop, formed from at least a part of the thin flat-conductor slapper detonator circuit, with the diameter of the first circular loop and the diameter of the second circular loop being approximately equal; and a ferrite housing, that provides a ferrite path for magnetically coupling the first loop and the second loop.

2. An apparatus as recited in claim 1, wherein the second planar and generally circular loop is formed from all of the thin flat-conductor slapper detonator circuit, so that the thin conductive metal foil is located within the ferrite housing; and with the apparatus further comprising a slapper detonator barrel associated with the thin conductive metal foil and incorporated within the ferrite housing, and a slapper detonator high-explosive pellet associated with the slapper detonator barrel and incorporated within the ferrite housing.

3. An apparatus as recited in claim 1, wherein the second planar and generally circular loop is formed from a part of the thin flat-conductor slapper detonator circuit, with the thin conductive metal foil located externally to the ferrite housing; wherein the ferrite housing is comprised of a ferrite circular annular ring, coaxially and encirclingly disposed about a solid central ferrite right circular cylinder, and two ferrite end cap disks symmetrically disposed perpendicularly to the axis of, and on either side of, the ring and cylinder; and with the apparatus further comprising a ceramic watertight seal extending from the ring to the cylinder.

4. An apparatus as recited in claim 3, further comprising an enclosure for the thick flat-conductor power cable, with the enclosure touchingly and circumferentially contiguous to the ferrite circular annular ring.

5. A slapper detonator-related method, for coupling a temporally short electric power pulse, that has a duration of from about 0.1 to 0.4 microseconds and a peak amplitude in the range extending from zero to about 10 kiloamps, from a thick flat-conductor power cable, that comprises an input conductor and an output conductor, into a thin flat-conductor slapper detonator circuit, that comprises a thin conductive metal foil that is, in use, adapted to be explosively vaporized by the electric power pulse, the method comprising the steps of:

circularly and planarly flaring apart an end portion of the input conductor and an adjoining end portion of the output conductor, and conductively joining the termini of the two flaired conductors, to form a first planar and generally circular loop;

fabricating at least a part of the thin flat-conductor slapper detonator circuit into a second planar and generally circular loop having a diameter that is approximately equal to the diameter of the first planar and generally circular loop;

placing the first and second planar and generally circular loops in close proximity with one another along their respective circumferences; and confining the first and second planar and generally circular loops within a ferrite housing that provides a ferrite path that magnetically couples the two loops.

6. A method as recited in claim 5, wherein the fabricating step is performed on all of the thin flat-conductor slapper detonator circuit so that the thin conductive metal foil is located within the ferrite housing; and with the method further comprising the step of incorporating a slapper detonator barrel within the ferrite housing and in association with the thin conductive metal foil, and the step of introducing a slapper detonator high-explosive pellet within the ferrite housing and in association with the slapper detonator barrel.

7. A method as recited in claim 5, wherein the fabricating step is performed on a part of the thin flat-conductor slapper detonator circuit with the thin conductive metal foil located externally to the ferrite housing; wherein the confining step is performed with a ferrite housing comprised of a ferrite circular annular ring that is coaxially and encirclingly disposed about a solid central ferrite right circular cylinder, with two ferrite end cap disks symmetrically disposed perpendicularly to the axis of, and on either side of, the ring and cylinder; and with the method further comprising the step of emplacing a watertight ceramic seal between the ring and the cylinder.

8. A method as recited in claim 7, the method further comprising the step of providing an enclosure for the thick flat-conductor power cable, with the enclosure touchingly and circumferentially contiguous to the ferrite circular annular ring.

* * * * *